United States Patent [19]

Redmond et al.

[11] Patent Number: 4,867,689

[45] Date of Patent: Sep. 19, 1989

[54] ELASTOMERIC CONNECTOR ASSEMBLY

[75] Inventors: John P. Redmond, Mechanicsburg; Ray N. Shaak, Lebanon; Larry J. Wilt, Harrisburg, all of Pa.

[73] Assignee: AMP Incorporated, Harrisburg, Pa.

[21] Appl. No.: 265,063

[22] Filed: Oct. 31, 1988

[51] Int. Cl.[4] ..... H01R 9/09

[52] U.S. Cl. ..... 439/71; 439/74; 439/91

[58] Field of Search ..... 439/71, 73–75, 439/80–83, 90, 91, 65, 263, 264, 382, 66

[56] References Cited

U.S. PATENT DOCUMENTS

| | | | |
|---|---|---|---|
| 4,194,800 | 3/1980 | Chow | 439/71 |
| 4,201,435 | 5/1980 | Nakamura et al. | 339/59 |
| 4,252,990 | 2/1981 | Sado | 339/59 |
| 4,402,562 | 9/1983 | Sado | 439/91 |
| 4,593,961 | 6/1986 | Cosmo | 439/66 |
| 4,652,973 | 3/1987 | Baker et al. | 439/91 |
| 4,688,864 | 8/1987 | Sorel | 439/74 |
| 4,692,790 | 9/1987 | Oyamada | 439/71 |

OTHER PUBLICATIONS

Article Entitled "Hybrid LCD Connector: Combining Pin-And-Socket and Elastomeric Mounts".

AT&T Article Entitled "Dataphone II—2700 Series DSU".

FIGS. 1 and 2 of Elastomeric Conn used by AT&T.

*Primary Examiner*—P. Austin Bradley

*Attorney, Agent, or Firm*—Bruce J. Wolstoncroft

[57] ABSTRACT

An elastomeric connector assembly (2) is disclosed for making electrical contact between a first electrical component (52) and a second electrical component (54). The connector assembly has at least one housing member (4, 6) which has a plurality of terminals (12, 14) and an elastomeric connector (16, 18) provided therein. The elastomeric connector electrically engages the terminals to provide numerous electrical pathways which extend through the housing member (4, 6) of the connector assembly (2). A camming means (8, 10) is provided proximate the housing member (4, 6), such that as the camming means (8, 10) is moved from a first position to a second position, the elastomeric connector (16, 18) is compressed to insure that a reliable electrical connection is effected and maintained between the the first electrical component (52) and the elastomeric connection (16, 18), and between the elastomeric connector and the terminals (12, 14).

14 Claims, 3 Drawing Sheets

ELASTOMERIC CONNECTOR ASSEMBLY

FIELD OF THE INVENTION

The invention relates to a connector assembly for making electrical contact between two electrical components. In particular, the invention is directed to an electrical connector which utilizes both elastomeric and metal contacts to provide the interconnection between the components.

BACKGROUND OF THE INVENTION

As a result of increasing complexity and miniaturization associated with electronic assembly and computer arts, the demand for more sophisticated and reliable connectors has increased. Smaller size, lighter weight packaging and an augmented necessity for reliability have reduced the use of individually soldered connectors in many areas of the industry. In many instances, there is a need for connectors which have the ability to reliably connect a large number of electrically conductive traces on closer centers in a compact area. In order to satisfy this need, the use of layered elastomeric connectors has become increasingly popular.

Layered elastomeric connectors are generally composed of alternating layers of dielectric elastomer and an elastomer filled or doped with electrically conductive material. The dielectric elastomer layers are sandwiched between the conductive layers and are of sufficient thickness to insulate the conductive layers from one another and therefore prevent the formation of electrically conductive or leakage pathways between the conductive layers. An example of such an elastomeric connector is described in copending application, Ser. No. 146,879, filed Jan. 22, 1988.

Layered elastomeric connectors have many electrical and mechanical characteristics which make their use desirable in many instances. Under the majority of circumstances, it is essential that the elastomeric connector be provided in a housing assembly, to give the elastomeric connector the structural support required to insure that a proper electrical connection has been effected and is maintained. Consequently, many housings for elastomeric connectors are known in the industry. However, under certain circumstances, it is desirable to have the elastomeric provided on one surface of the housing assembly, and pins provided on the opposed surface of the assembly, thereby allowing such things as a printed circuit board to be connected to a liquid crystal display.

The majority of the housings available in the industry require various pieces of mounting hardware in order for the proper electrical connection to be effected. This mounting hardware requires a significant portion of board and housing space, in relation to the elastomeric connector. As miniaturization is required in many instances, the use board space for mounting hardware is unacceptable.

In order to provide a miniaturized housing assembly which insures that the elastomeric connector will be provided in electrical engagement with the metal contacts, it is essential that the elastomeric be maintained in precise position with a minimum of mounting hardware, and it is important that the interconnection surfaces between the elastomeric connector and the metal contacts be free of any oxides or the like. The present invention is directed to such a connector assembly.

SUMMARY OF THE INVENTION

The present invention is directed to a connector which utilizes an elastomeric member therein. The electrical connector is used to electrically connect a printed circuit board or the like to an electrical component, such as a second printed circuit board.

The electrical connector has at least one housing member which has a first surface and an oppositely facing second surface. An elastomeric receiving means is provided in the housing member proximate the first surface. Terminal receiving openings extend from the elastomeric receiving means to the second surface of the housing member, the terminal receiving openings have terminals provided therein. The terminals extend from the terminal receiving openings into the elastomeric receiving means.

An elastomeric member is positioned in the elastomeric receiving means, and retained therein in a position where a first portion of the elastomeric member extends beyond the first surface of the housing member. This configuration allows the electrical component to engage the first portion of the elastomeric member rather than the first surface of the housing member, when the electrical component is moved into alignment with the electrical connector.

Camming means are provided on the housing member. The camming means are movable between a first position and a second position, such that the electrical component can be inserted into the connector when the camming means is in the first position. The electrical component being properly inserted when conductive areas of the electrical component are provided in alignment with the elastomeric member of the electrical connector. In this arrangement, as the camming means is moved from the first position to the second position, the electrical component cooperates with the first portion of the elastomeric member, to force the first portion of the elastomeric member into the elastomeric receiving means, thereby forcing the elastomeric connector into a positive electrical connection with the terminals. Consequently, a positive electrical pathway is provided from the first surface of the housing member to the second surface.

DETAILED DESCRIPTION OF THE INVENTION

Figure 1:
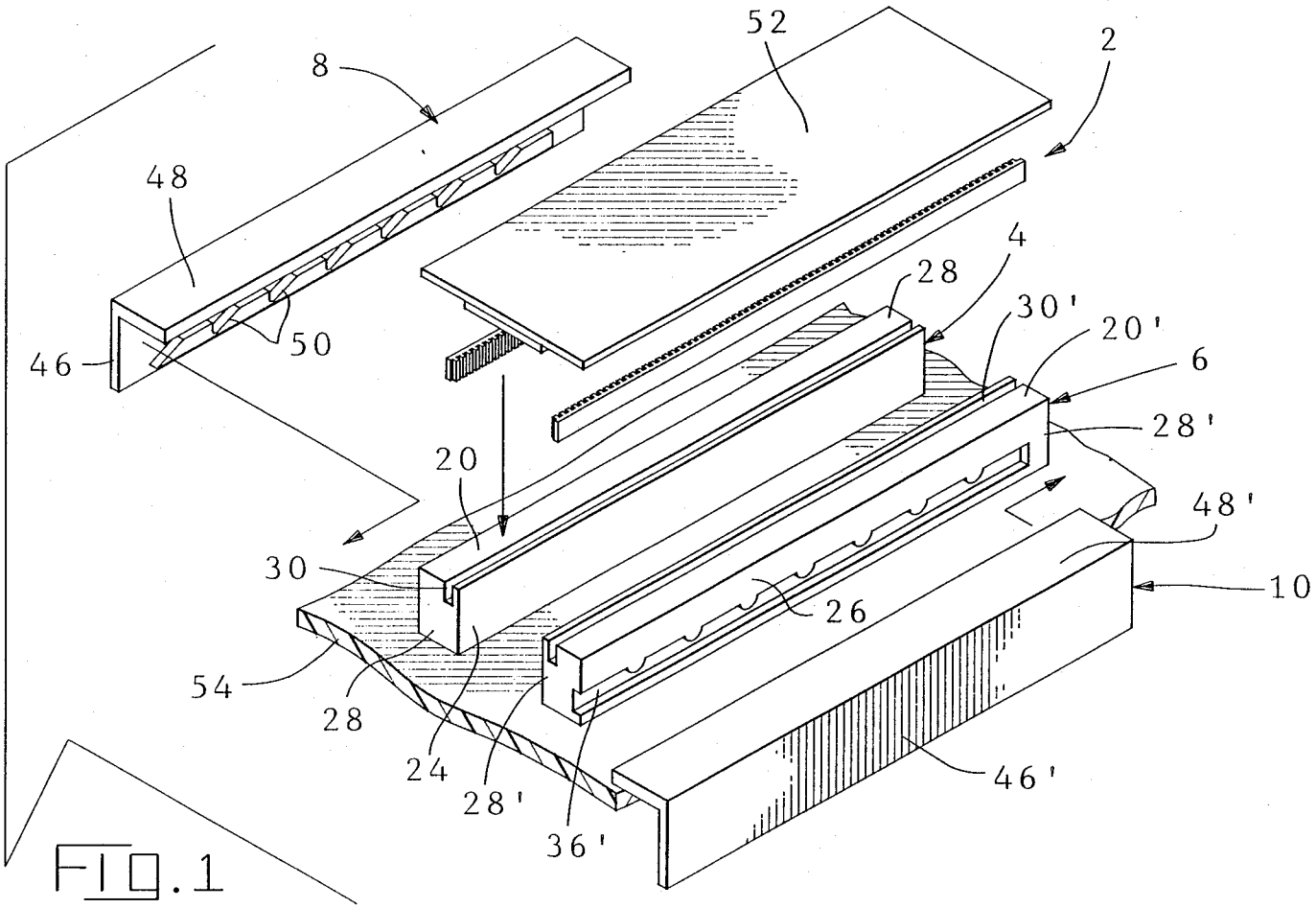
FIG. 1 is an exploded isometric view of the elastomeric connector assembly of the present invention.
Figure 2:
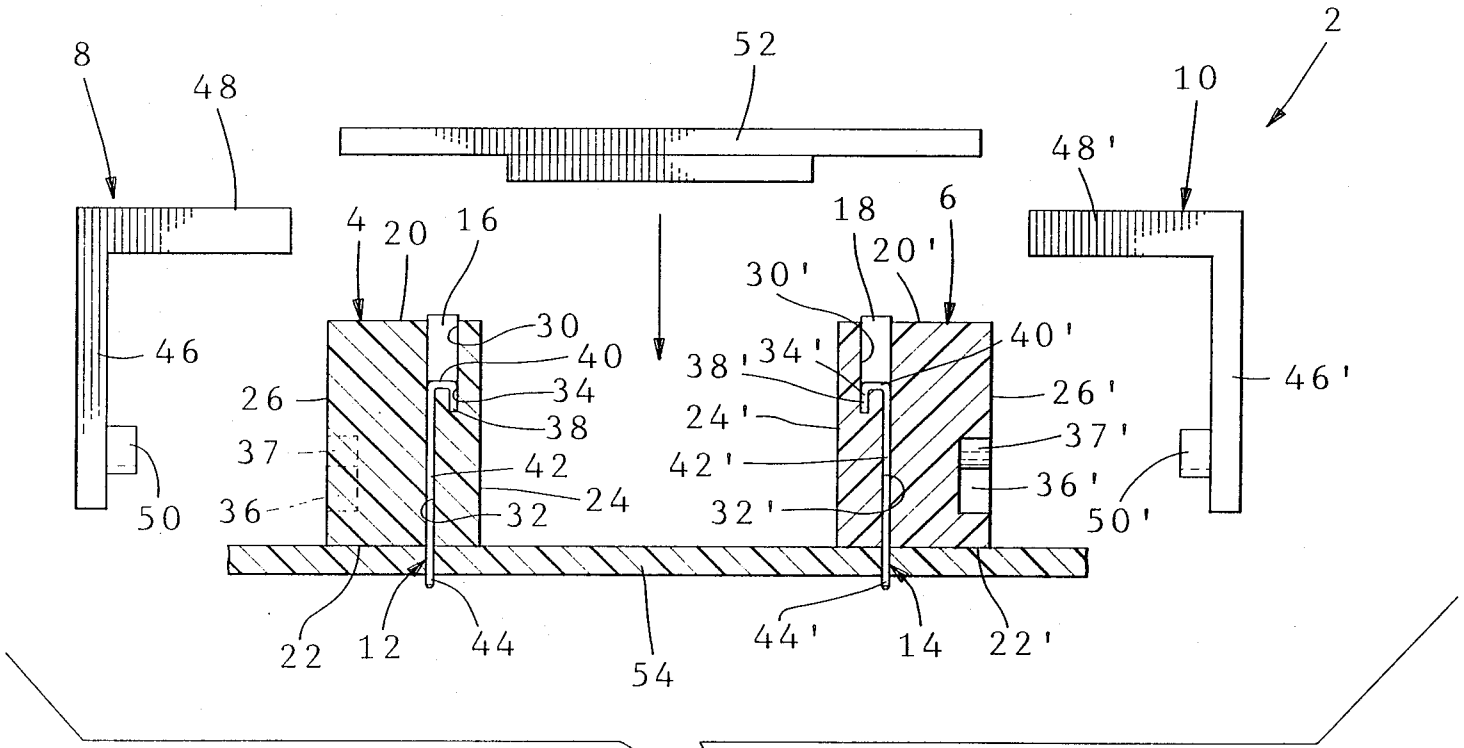
FIG. 2 is a partial cross-sectional view of the connector assembly showing the various parts prior to a display board being placed in electrical engagement with the elastomeric.

The connector assembly 2, as best shown in FIGS. 1 and 2, has a first housing member 4, a second housing member 6, a first camming member 8, and a second camming member 10. First housing member 4 and second housing member 6 have respective terminals 12, 14 (FIG. 2) which extend partially therethrough, and respective elastomeric connectors 16, 18 which cooperate with the terminals to provide electrically conductive pathways through the housing members.

Housing members 4, 6 are identical to each other, with the exception that second housing member 6 is a mirror image of first housing member 4. Therefore, a description of the first housing member 4 will suffice for both housing members. The same reference numerals, differentiated by prime marks, are used to describe the two housing members. It should be noted that it is not essential for housing members 4, 6 to be mirror images of each other.

Housing member 4 has a top surface 20, a bottom surface 22 an inside side surface 24, an outside surface 26, and end surfaces 28. An elastomeric receiving slot 30 is provided in the housing member, and extends from the top surface 20 toward the bottom surface 22, as best shown in FIG. 2. The elastomeric receiving slot 30 extends the entire length of the housing, from one end surface 28 to the opposed end surface 28.

Terminal receiving openings 32 (FIG. 2) are provided in cooperation with slot 30, such that the terminal receiving openings 32 extend from the bottom surface 22 of the housing member 4 to the slot 30. Terminal positioning openings 34 are provided proximate openings 32. Each opening 32 has a respective opening 34 provided in alignment therewith, such that the plane defined by each opening 32 and respective opening 34 is essentially parallel to each other, and essentially parallel to the end surfaces 28 of the housing member 4. As is shown in FIGS. 2 and 3, terminal positioning openings 34 extend from slot 30 toward bottom surface 22, but do not intersect bottom surface 22.

Figure 4:
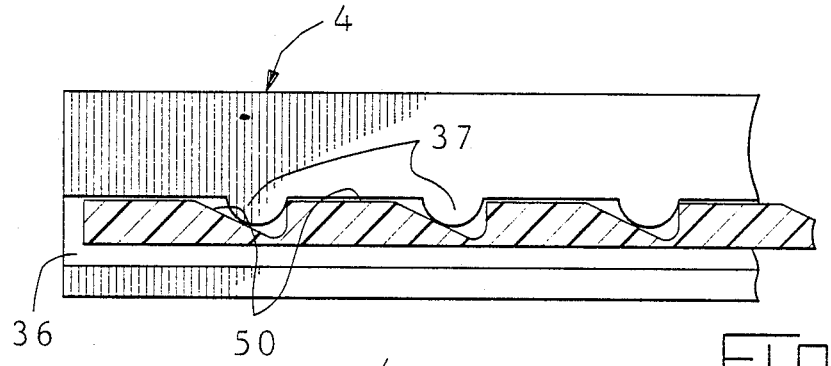
FIG. 4 is a cross-sectional view showing the camming means in a closed position.
Figure 5:
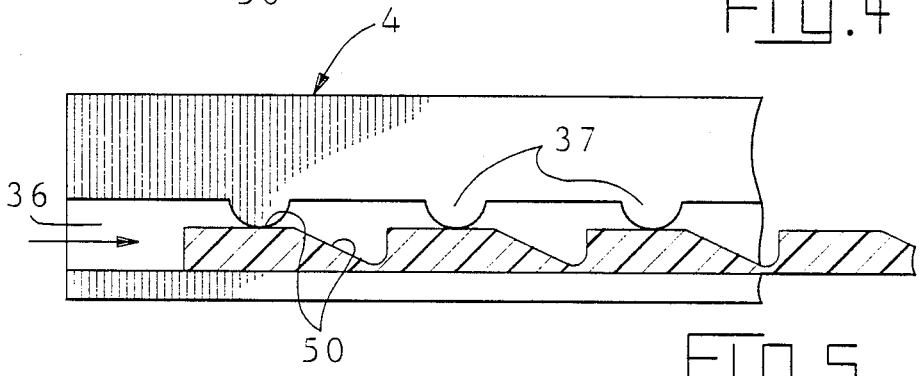
FIG. 5 is a cross-sectional view, similar to that of FIG. 4, showing the camming means in an open position.

As best shown in FIG. 1, 4, and 5, housing member 4 has a camming slot 36 which extends across essentially the entire length of the housing member, from one end surface 28 to proximate the opposed end surface 28. Camming slot 36 extends from the outside side surface 26 toward the inside side surface 24. Camming means or projections 37 extend from an upper surface of the camming slot. The particular configuration of the projections of the disclosed embodiment is best shown in FIGS. 4 and 5, although other configurations are possible.

Figure 3:
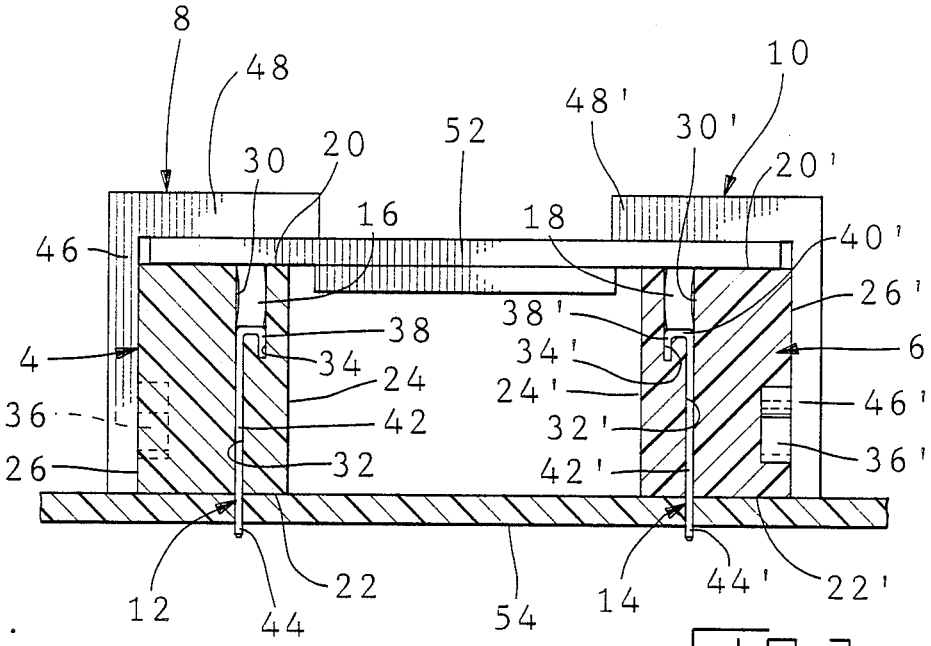
FIG. 3 is a partial cross-sectional view, similar to that shown in FIG. 2, showing the connector in the fully assembled position.

Terminals 12, 14, as best shown in FIGS. 2 and 3, are positioned in openings 32, 34 and slot 30, of housing members 4. Terminals 14 are likewise positioned in openings 32', 34' and slot 30' of housing member 6. As terminals 12, 14 are identical to each other, a description of terminals 12 will suffice for all terminals. The same reference numerals, differentiated by prime marks, are used to describe the terminals.

Each terminal 12 has an alignment portion 38, an elastomeric mating portion 40, a securing portion 42, and a board mating portion 44. The securing portions 42 are positioned in terminal receiving openings 32. The diameters of securing portions 42 are slightly larger than the diameters of openings 32, such that as the terminals are inserted into the housing member, the securing portions 42 will frictionally engage the sides of the openings 32, thereby maintaining the terminals in the inserted position.

Alignment portions 38 of the terminals 14 are positioned in terminal alignment openings 34 when the terminals are inserted into openings 32. As the alignment of openings 32, 34 is accurately controlled, the positioning of the terminals in the openings insures that the positioning and spacing of the terminals will be precisely maintained in housing member 4 of connector assembly 2.

Elastomeric mating portions 40 of terminals 12 extend into elastomeric receiving slot 30. It is important that the elastomeric mating portions 40 have a large surface area provided in slot 30, so that a large contact area will be provided in which the elastomeric connector 16 will electrically engage terminals 12, as will be discussed below.

As shown in FIGS. 2 and 3, the elastomeric connectors 16, 18 are provided in slots 30, 30' of housing members 4, 6. As elastomeric connectors 16, 18 are identical to each other, a description of elastomeric connector 16 will suffice for both elastomeric connectors.

As shown in FIG. 2, prior to an electrical component 52 being placed in engagement with housings 4, 6, respective elastomeric connectors 16, 18 are provided in slots 30, 30', such that a top portion of the elastomeric connector 16, 18 extends beyond the upper surfaces 20, 20' of housing members 4, 6. In this preassembled position, elastomeric connectors 16, 18 are maintained in slots 30, 30' due to the frictional engagement between the sidewalls of the elastomeric connectors and the sidewalls of the slots.

The elastomeric connectors used can be of the type disclosed in U.S. patent application Ser. No. 7/148,191, now U.S. Pat. No. 4,820,170, the description of which is hereby incorporated by reference. This particular type of elastomeric connector has fibers which extend from end surfaces thereof. In the alternative, the elastomeric connectors used in the assembly can be of any type available in the market place.

Provided on the outside side surfaces 26, 26' of housing members 4, 6 are camming members 8, 10. As camming members 8, 10 are identical to each other, a description of camming member 8 will suffice for both camming members. The same reference numerals, differentiated by prime marks, are used to describe the camming members.

Camming member 8 has a generally L-shaped configuration, as is best shown in FIGS. 2 and 3. The camming member has a portion 46 which extends essentially parallel to the outside side surface of the housing member, and a portion 48 which extends essentially parallel to the upper surface. Cam followers 50 are provided on portion 46, and extend from portion 46 in essentially the same direction as the portion 48.

In operation, each housing member 4, 6 is positioned on a printed circuit board 54 or the like. The board mating portions 44, 44' of the terminals cooperate with plated through holes or conductive pads on the circuit board to provide the electrical path required between the housing members and the printed circuit board.

Conductive paths are provided through the housing members by the cooperation of elastomeric connectors 16, 18 with elastomeric mating portions 40, 40' of the terminals. The conductive regions of the elastomeric connectors electrically engage the elastomeric mating portions when the elastomeric connectors are properly positioned in slots 30, 30'. It is to be noted that elastomeric mating portions 40, 40' of terminals 12, 14 extend into slots 30, 30', such that elastomeric connectors 16, 18 electrically engage a large surface area of each terminal. This large contact area provides a redundancy which insures that a positive electrical connection is effected between terminals 12, 14 and elastomeric connectors 16, 18.

As was previously stated, elastomeric connectors 16, 18 are maintained in slots 30, 30' of housing members 4, 6 by the frictional engagement between the walls of the slots and the walls of the connectors. The positioning of elastomeric mating portions 40, 40' of terminals 12, 14 is slots 30, 30' also adds to the retention of the elastomeric connectors.

In order to provide a means to electrically connect elastomeric connectors 16, 18 with electrical component 52, the elastomeric connectors extend beyond upper surfaces 20, 20' of housing members 4, 6. This allows conductive areas of the electrical component to engage the elastomeric connectors.

Electrical component 52 is positioned over upper surfaces 20, 20' of housing members 4, 6, such that conductive areas of the electrical component are aligned with respective elastomeric connectors 16, 18. The electrical component is then moved into engagement with the elastomeric connectors. With the electrical component resting on the elastomeric connectors, the camming members 8, 10 are brought into engagement with the respective housing members 4, 6.

As shown in FIGS. 4 and 5, camming members 8, 10 are moved from an open position to a closed position. In the open position, as shown in FIG. 4, camming projections 37, 37' of housing members 4, 6 are aligned with recesses which are provided between cam followers 50, 50' of camming members 8, 10. This allows the camming members to fit loosely over the housing members and the electrical component. However, when the camming members are moved to the closed position (FIG. 5), the cam followers 50, 50' engage the camming projections, to force camming members 8, 10 downward with respect to housing members 4, 6. This downward motion causes portions 48, 48' of camming members 8, 10 to clamp and maintain electrical component 52 in relation to the housing members 4, 6.

As camming members 8, 10 are moved from the open position to the closed position, elastomeric connectors 16, 18 are forced to compress, as is shown in FIG. 3. This compression insures that the elastomeric connectors effect a positive electrical connection with the conductive areas of the electrical component. The compression of the elastomeric connectors also insures that a positive electrical connection is effected between the terminals and the elastomeric connectors. As elastomeric connectors 16, 18 are compressed, the conductive material provided in the connectors provides a wiping action on terminals 12, 14. This wiping action removes any unwanted contaminants provided on the surfaces of the terminals.

The positive wiping action supplied by this connector assembly is one advantage of the assembly. However, other advantages are provided. The compression of the elastomeric connectors about the terminals provides an environmental seal about the terminals. Consequently, the wiping action and the sealing action of the elastomeric connectors with the terminals provides the connector assembly with a much more reliable and effective electrical connection over time.

The use of camming means provides an evenly distributed and consistent force, no matter the length of the connector assembly. This is important due to the fact that the electrical component will have a tendency to bow as pressure is applied thereto, particularly when the force is applied to the ends of the component, causing several of the electrical connections to be ineffective. However, because of the even distribution of forces associated with the camming members, this problem of bowing and faulty electrical connections is essentially eliminated.

The connector assembly of the present invention is easy to manufacture and assemble. Consequently, the connector assembly can be installed by automated equipment, as well as manually. The removal of the electrical component from the connector assembly is also made easy, as no tools are required. This facilitates the replacement of the electrical component.

Changes in the construction will occur to those skilled in the art and various apparently different modifications and embodiments may be made without departing from the scope of the invention. The matter set forth in the foregoing description and accompanying drawings is offered by way of illustration only.

We claim:

1. An electrical connector assembly comprising:

a housing member having a first surface and a second surface, a recess is provided in the housing member, the recess extends from the first surface toward the second surface, terminal receiving opening extend from the recess to the second surface of the housing member, a camming surface is provided on the housing member;

terminals are provided in the terminal receiving openings, the terminals extend from beyond the second surface to beyond an end surface of the recess;

an elastomeric connector is provided in the recess, the elastomeric connector electrically engaging a portion of the terminals which extends beyond the end surface of the recess, the elastomeric connector frictionally engages side walls of the recess, such that the elastomeric connector is positively retained in the recess of the housing member;

camming means provided to cooperate with an electrical component, such that as the camming means is moved to an open position, the electrical component can be inserted between the first surface of the housing member and a section of the camming means, and as the camming means is moved to the closed position, the electrical component is forced into electrical engagement with the elastomeric connector;

whereby as the camming means is moved from the open position to the closed position, the elastomeric connector is forced to compress in the recess of the housing member, causing the elastomeric connector to exert a wiping action on the portion of the terminals which extends into the recesses, thereby insuring that a positive electrical connection is effected between the elastomeric connector and the terminals.

2. An electrical connector assembly as recited in claim 1 wherein the electrical connector assembly has two housing members, the housing members being spaced from each other, the first housing member is essentially a mirror image of the second housing member.

3. An electrical connector assembly as recited in claim 1 wherein the elastomeric connector has fibers which extend therethrough, the fibers cooperate with the terminals as the elastomeric connector is forced to compress to provide the wiping action on surfaces of the terminals.

4. An electrical connector assembly as recited in claim 1 wherein as the elastomeric connector is compressed, the elastomeric connector will cooperate with side walls of the recess to provide an environmental seal about the terminals.

5. An electrical connector assembly as recited in claim 1 wherein the terminals have elastomeric mating portions which extend into the recess of the housing member, the elastomeric mating surface having a relatively large contact area with which the elastomeric connector engages to provide the electrical connection between the terminals and the elastomeric connector.

6. An electrical connector assembly as recited in claim 5 wherein the elastomeric mating portions of the terminals have alignment portions extending from ends thereof, the alignment portions cooperate with alignment openings of the housing member to insure that the elastomeric mating portions of the terminals are properly positioned in the housing member.

7. An electrical connector assembly as recited in claim 1 wherein the camming means has camming projections which extend therefrom, the camming projections are provided in engagement with the camming surface of the housing member when the camming means is in the closed position.

8. An electrical connector assembly as recited in claim 7 wherein the camming means has an electrical component engagement surface which cooperates with the electrical component as the camming means is moved from the open position to the closed position, the electrical component engagement surface distributes an even force over the electrical component to force the electrical component into electrical engagement with the elastomeric connector, the distribution of forces on the electrical component prevents the electrical component from bowing during the operation thereof, such that a positive electrical connection is effected between the electrical component and the elastomeric connector.

9. An electrical connector for electrically connecting a printed circuit board to an electrical component, the electrical connector comprising:

at least one housing member having a first surface and an oppositely facing second surface, an elastomeric receiving means provided in the housing member proximate the first surface, terminal receiving openings extend from the elastomeric receiving means to the second surface of the housing member, terminals provided in the terminal receiving openings, the terminals extend into the elastomeric receiving means, an elastomeric member provided in the elastomeric receiving means, the elastomeric member frictionally engages side walls of the elastomeric receiving means, such that the elastomeric member is positively retained in the elastomeric receiving means in a position where a first portion of the elastomeric member extends beyond the first surface of the housing member, camming means which are movable between a first position and a second position, such that the electrical component is inserted into the connector when the camming means is in the first position, so that conductive areas of the electrical component are provided in alignment with the elastomeric member of the connector, whereby as the camming means is moved from the first position to the second position, the electrical component cooperates with the first portion of the elastomeric member, to force the first portion of the elastomeric member into the elastomeric receiving means, thereby forcing the elastomeric connector into a positive electrical connection with the terminals.

10. An electrical connector as recited in claim 9 wherein the elastomeric receiving means are slots which extend from the first surface of the housing member toward the second surface.

11. An electrical connector as recited in claim 9 wherein the elastomeric member has fibers which extend therethrough, the fibers cooperate with the terminals as the first portion of the elastomeric connector is forced into the elastomeric receiving means to provide a wiping action on surfaces of the terminals.

12. An electrical connector as recited in claim 9 wherein the terminals have elastomeric mating portions which extend into the elastomeric receiving means, alignment portions extend from ends of the elastomeric mating portions, the alignment portions cooperate with alignment openings of the housing member to insure that the elastomeric mating portions of the terminals are properly positioned in the housing member.

13. An electrical connector as recited in claim 9 wherein the camming means has camming projections which extend therefrom, the camming projections are provided in engagement with camming surfaces of the housing member when the camming means is in the second position.

14. An electrical connector as recited in claim 13 wherein the camming means has an electrical component engagement surface which cooperates with the electrical component as the camming means is moved from the first position to the second position, the electrical component engagement surface distributes an even force over the electrical component to force the electrical component into electrical engagement with the elastomeric member, the distribution of forces on the electrical component prevents the electrical component from bowing during the operation thereof, such that a positive electrical connection is effected between the electrical component and the elastomeric member.

* * * * *